US007637120B1

(12) United States Patent
Doss

(10) Patent No.: US 7,637,120 B1
(45) Date of Patent: Dec. 29, 2009

(54) CONTAINER HOLDING DEVICE

(76) Inventor: Brian Edward Doss, 978 US Highway 68 East, Benton, KY (US) 42025

( * ) Notice: Subject to any disclaimer, the term of this patent is extended or adjusted under 35 U.S.C. 154(b) by 423 days.

(21) Appl. No.: 11/365,183

(22) Filed: Mar. 1, 2006

(51) Int. Cl.
*F25D 25/00* (2006.01)

(52) U.S. Cl. ..... 62/378; 62/457.1

(58) Field of Classification Search ..... 62/378, 62/87, 401, 381, 457.1, 457.4, 457.8
See application file for complete search history.

(56) References Cited

U.S. PATENT DOCUMENTS 2,746,330 A * 5/1956 Pfetzing ..... 81/124.7
4,714,138 A * 12/1987 Zaccone ..... 184/1.5
4,867,017 A * 9/1989 Holman ..... 81/121.1
4,951,890 A * 8/1990 Sossamon ..... 242/486.8
5,440,957 A 8/1995 Rogers
5,469,935 A 11/1995 Hewuse
6,227,078 B1 5/2001 Lemmo, Jr.
7,086,622 B1 * 8/2006 Whaley ..... 242/323

* cited by examiner

*Primary Examiner*—Melvin Jones
(74) *Attorney, Agent, or Firm*—Laura M. Hagan; Kerrick, Stivers, Coyle & Van Zant PLC

(57) ABSTRACT

The container holding device is designed to improve the process of cooling liquids within containers. The present invention comprises a gripping device, which holds a container of fluid, and a drive shaft which is designed so that it can be securely inserted into the chuck of a hand held motorized rotary device. The inner surface of the gripping device frictionally retains a container securely, while the container is submerged into a chest filled with ice or an icy water solution and the hand held motorized rotary device actuated. The rotation accelerates the transference of the heat from the container into the colder ice or icy solution. A detachable handle, capable of connecting to the drive shaft, may also be used to allow the user to manually spin the container of fluid if a hand held motorized rotary device is not available.

7 Claims, 9 Drawing Sheets

CONTAINER HOLDING DEVICE

BACKGROUND OF THE INVENTION

The present invention relates primarily to a container holding device which can be attached to any standard hand held motorized rotary device and used to quickly cool the liquid in the container. The present invention uses a common household tool which can be easily transported to a remote location, such as camping, on a golf course or on a boat.

All of the devices in the prior art require use of a permanently attached rotary device to rotate a can for cooling within an ice chest. The present invention is simple in design and uses a hand held motorized rotary device which is already present in nearly every household. This feature makes the present invention much more economical to manufacture and easier to transport.

SUMMARY OF THE INVENTION

The container holding device is designed to be a quick, easy and inexpensive way to cool beverages. In many situations, packing a cooler or chest of ice which is large enough to carry a sufficient number of beverages is impractical, such as on a golf trip, while camping or on a boat, to name a few. By using the container holding device, a small cooler can be sufficient to cool many beverages.

The present invention is comprised of two simple elements: a gripping device and a drive shaft. The gripping device is adapted to frictionally grip a beverage container, whether it be a can or a bottle. Extending from the gripping device is a drive shaft which is designed to fit into the chuck of a hand held motorized rotary device, such as a cordless drill. Use of the present invention is achieved by inserting and securing the drive shaft into the chuck of the hand held motorized rotary device and inserting the beverage to be cooled into the gripping device. The beverage is then inserted into an ice chest or icy solution. By activating the motorized rotary device, the drive shaft of the present invention is rotated, which in turn rotates the gripping device holding the container of liquid. This rotation of the container of liquid in the ice chest effectively transfers the heat from the liquid into the icy solution and quickly cools the beverage for more palatable consumption.

DETAILED DESCRIPTION OF THE INVENTION

Figure 1:
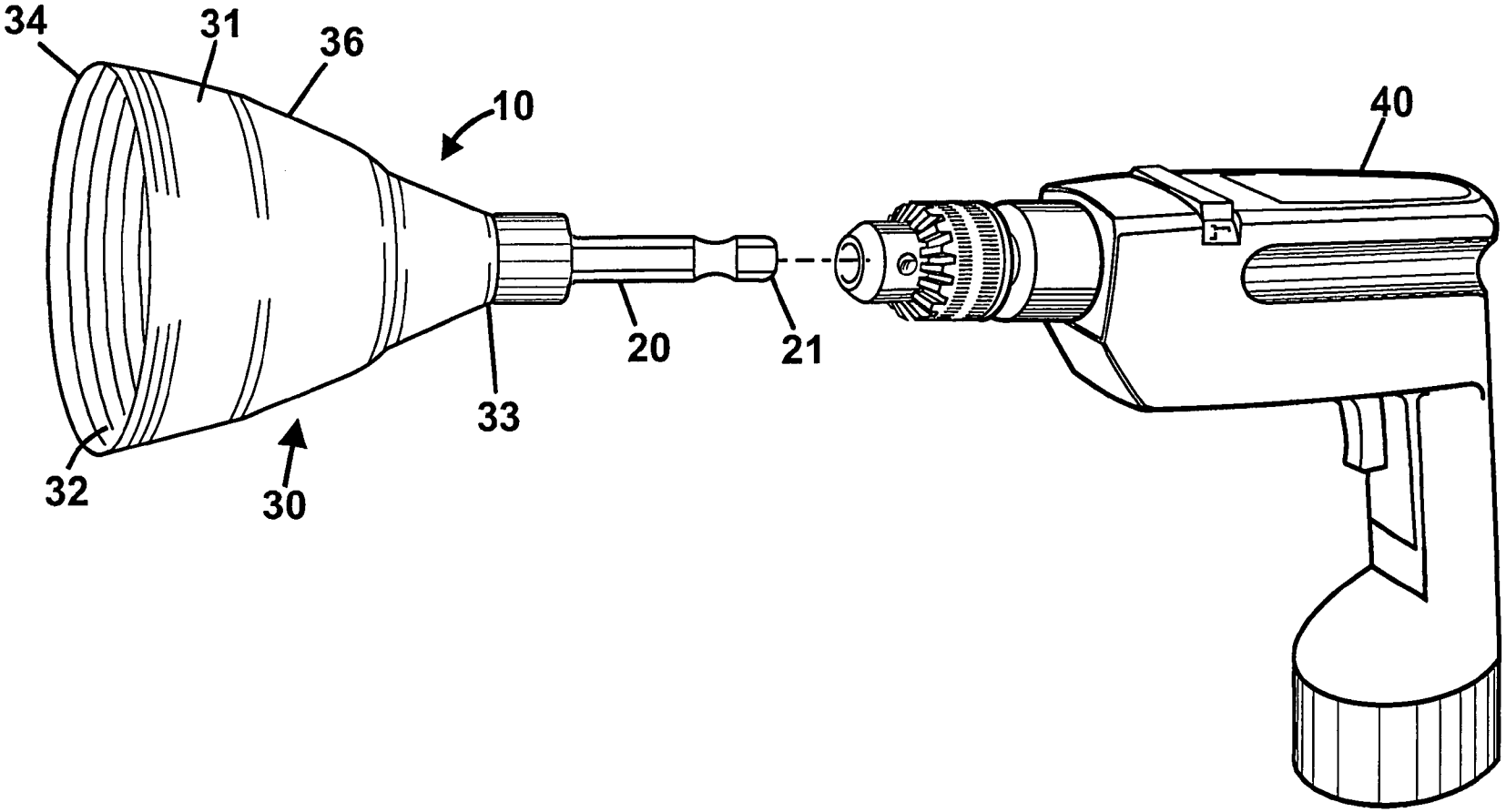
FIG. 1 is a perspective view of the present invention and a hand held motorized rotary device.
Figure 2:
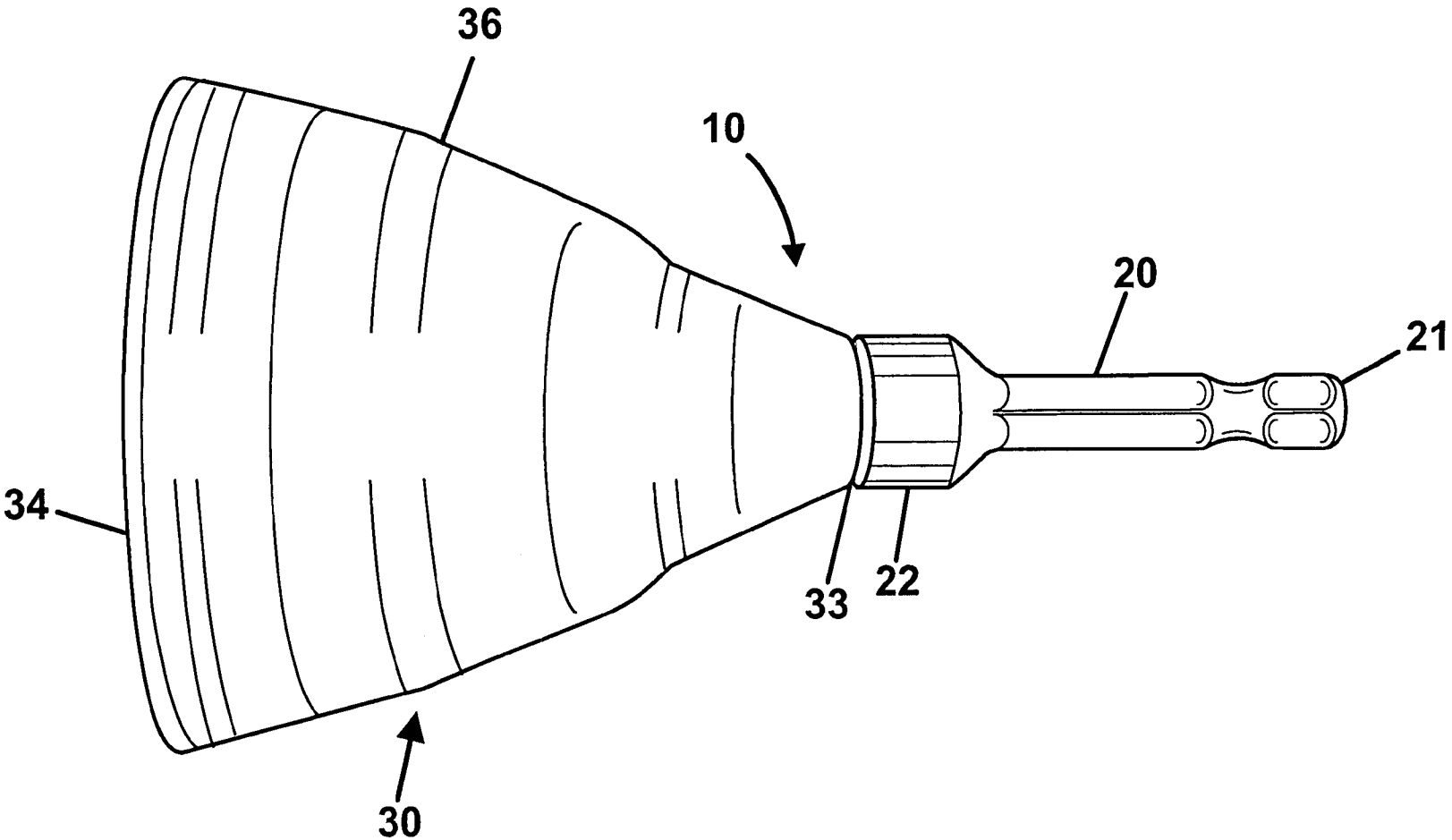
FIG. 2 is a side view of the present invention.
Figure 3:
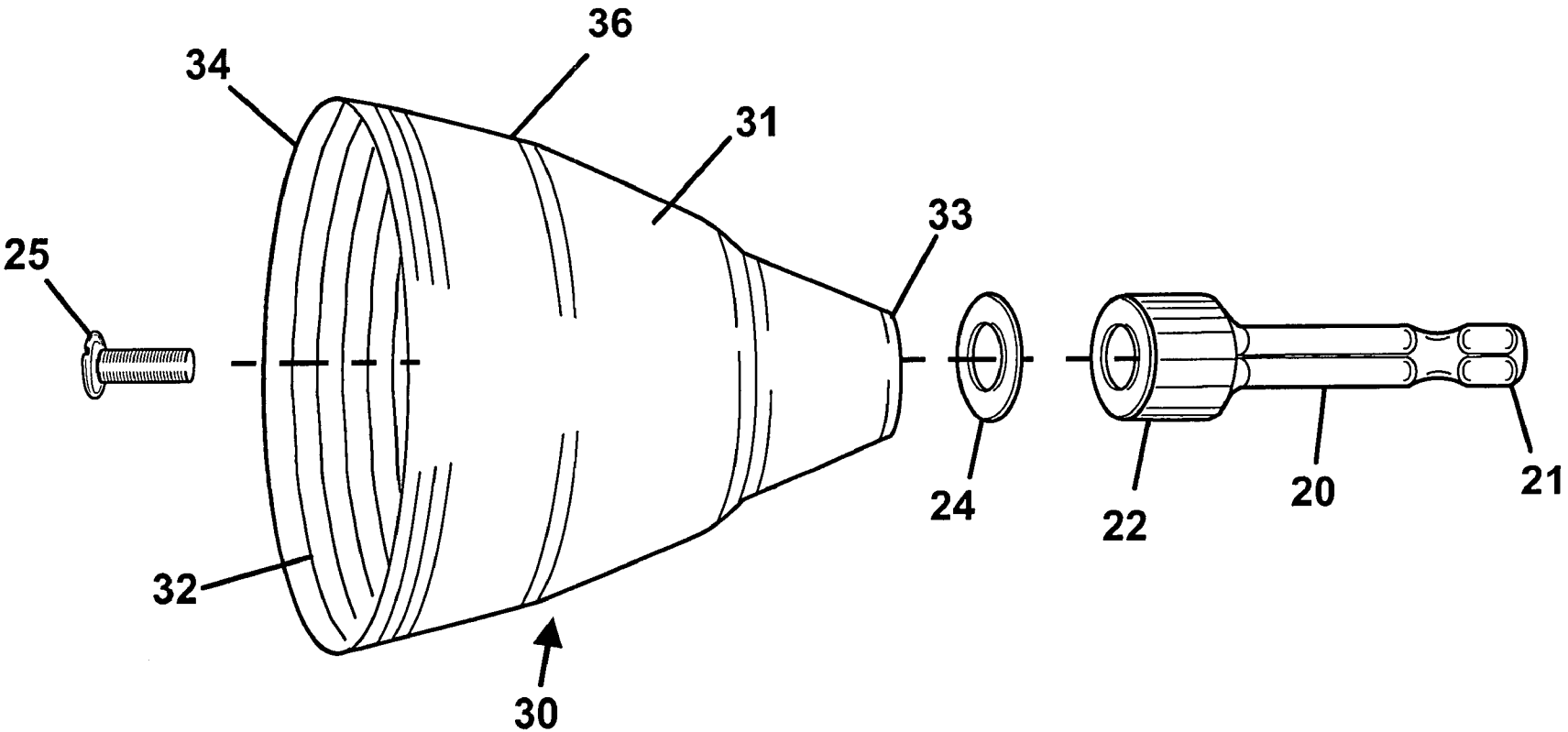
FIG. 3 is an exploded perspective view of the present invention.
Figure 5:
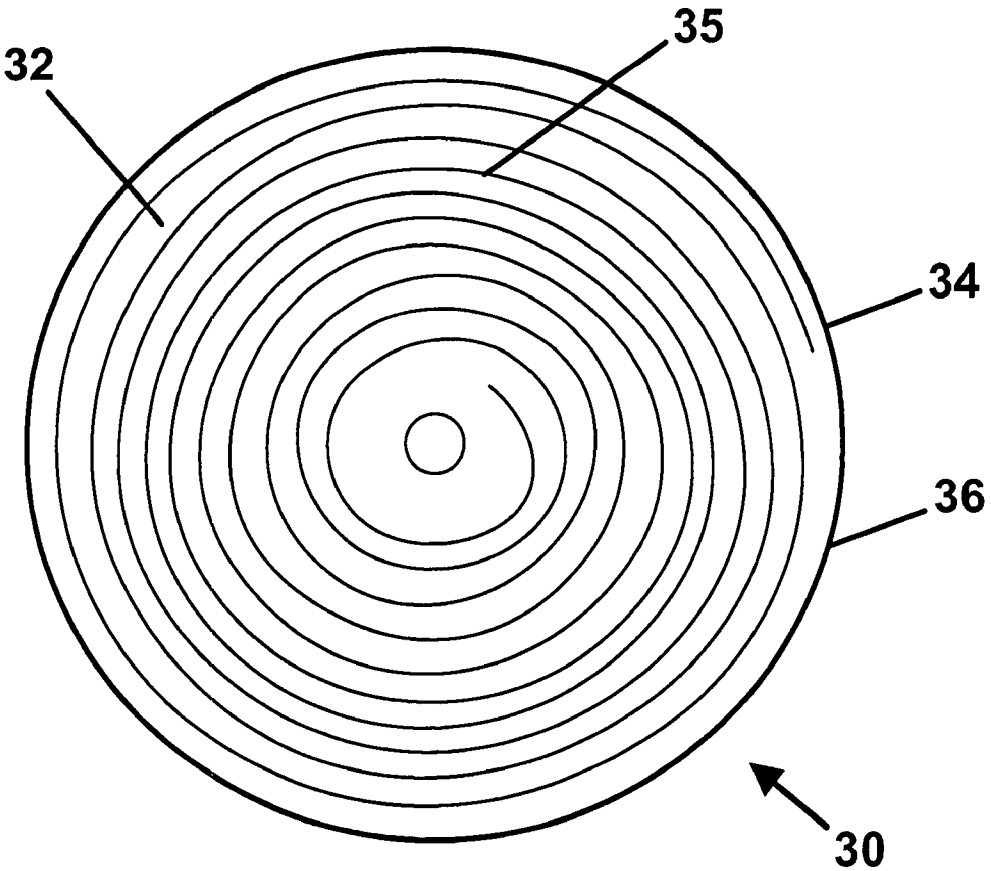
FIG. 5 is a view of the inner surface of the gripping device.
Figure 7:
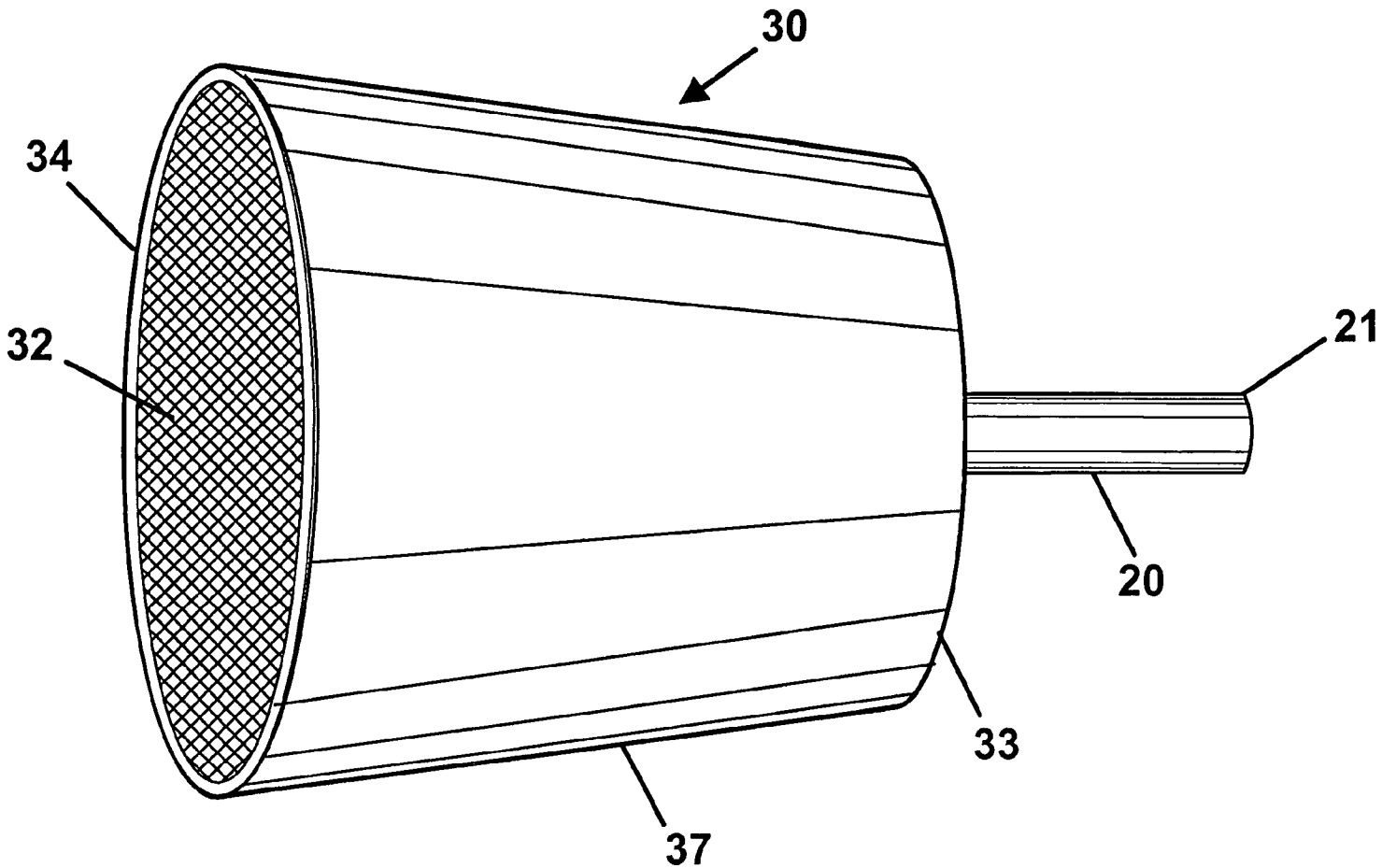
FIG. 7 is a perspective view of the present invention with a gripping device in the shape of a tapered cylinder.
Figure 8:
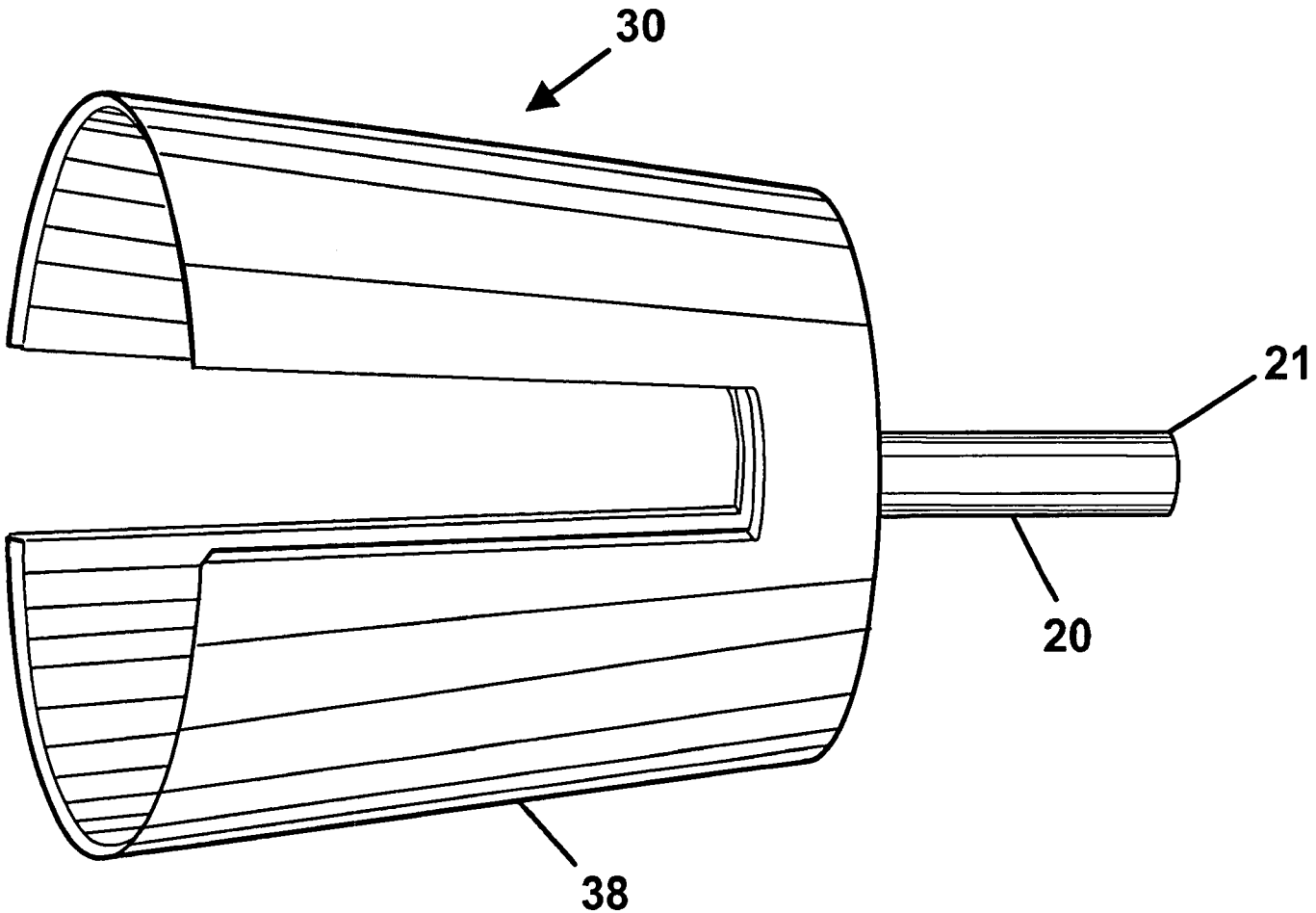
FIG. 8 is a perspective view of the present invention with a gripping device with at least two finger-like projections.

As is shown in FIG. 1 and FIG. 2, the present invention is comprised of a gripping device 30 attached to a drive shaft 20, which can be inserted into the chuck of a hand held motorized rotary device 40. The portion of the present invention which holds the container is the gripping device 30 and is typically made of a plastic, elastomer material, polymer, copolymer, rubber, aluminum and/or aluminum alloys or any material with sufficient strength and similar properties. FIG. 3 and FIG. 5 show an embodiment of the gripping device 30, which is essentially an open cavity which extends from a wide second end 34 to a narrow first end 33. The second end 34 has a larger diameter than the first end 33. The gripping device 30 can be shaped in a variety of structures which would frictionally hold a container. FIG. 2 and FIG. 5 show the gripping device 30 in the shape of a cone 36. FIG. 7 shows the gripping device 30 in the shape of a tapered cylinder 37, and FIG. 8 shows a gripping device 30 which has at least two finger-like projections 38 which frictionally hold the container.

The gripping device 30 also has an inner and outer surface 32, 31. The inside surface 32 is adapted to securely maintain a container, can or bottle when it is inserted into the second end 34 of the gripping device 30. The wall thickness of the gripping device 30 is thin and designed to display adequate strength to hold and maintain the grip of a container when it is inserted into the open cavity of the second end 34 of the gripping device 30. The inner surface 32 of the gripping device 30 has a textured surface so as to frictionally grip the container. As is shown in FIG. 5, the inner surface 32 of the gripping device could incorporate a continuous spiral design 35 that is protruded from the inner surface 32 and extends from the first end 33 to the second end 34 of the gripping device 30. FIG. 7 also shows another common textured surface capable of frictionally retaining a container within the gripping device. The inner surface could be formed into a series of rings, waffle shapes, bumps, etc., which would serve to securely grip a variety of sizes of containers.

When a can or bottle is inserted into the inner surface 32 of the gripping device 30, a twisting motion forces the can or bottle upward and inward to the first end 33 of the gripping device 30. The textured inner surface 32 and the tight fit of the gripping device 30 over the end of the can or bottle holds the container in a secure fashion. The outer surface 31 of the gripping device can be any type of texture, including, but not limited to, smooth, rough or other desired surface. The length and the diameter of the gripping device 30 may vary to accommodate various types of bottles and cans.

Figure 6:
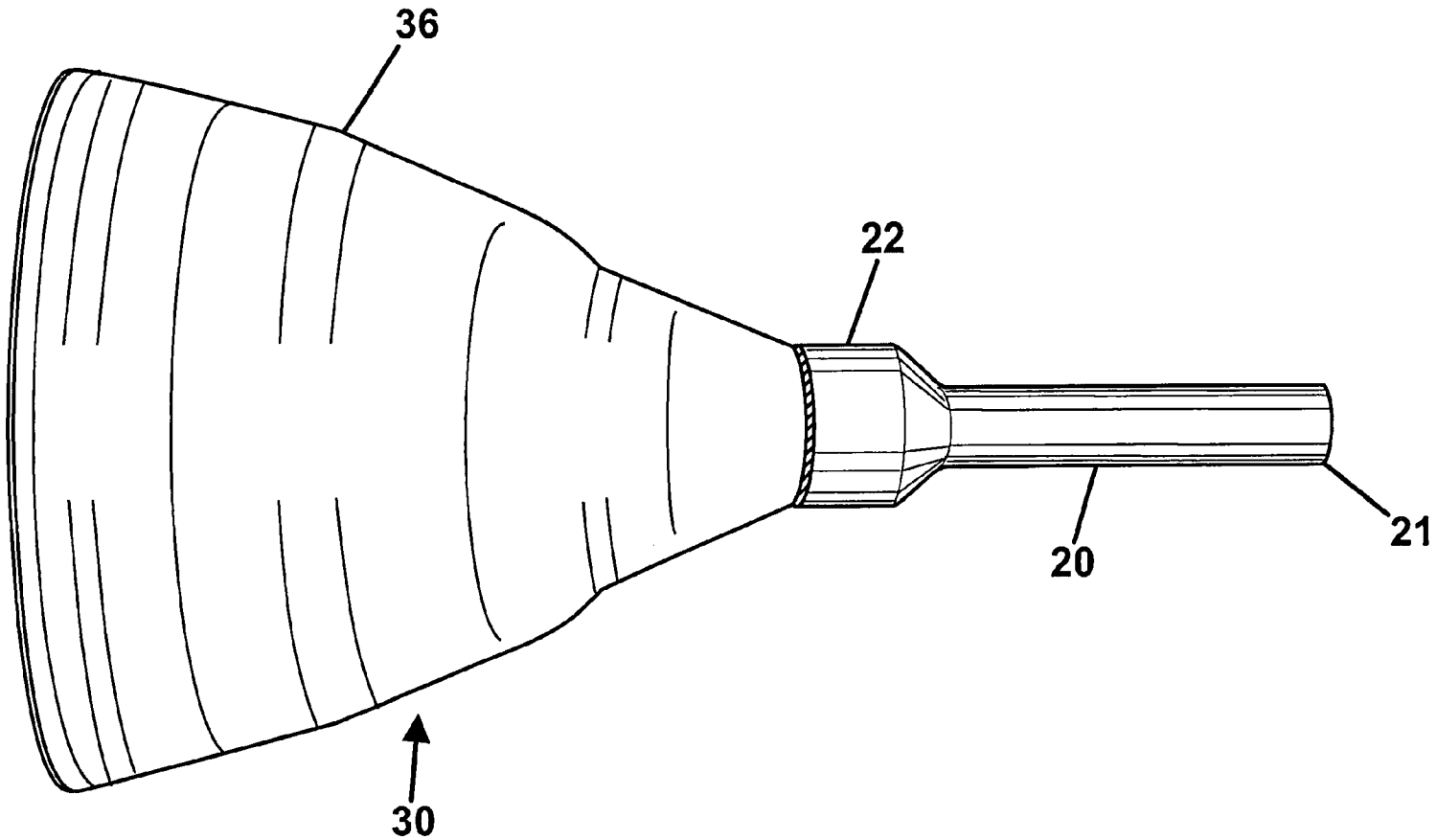
FIG. 6 is a side view of the present invention with a smooth shaft.

Attached to and extending from the first end 33 of the gripping device 30 is a drive shaft 20 with a first and second end 21, 22. The second end 22 of the drive shaft 20 secures the first end 33 of the hollow gripping device 30. The gripping device 30 can be secured with a screw or another similar device, which inserts into the second end 22 of the drive shaft 20. Additionally, the drive shaft 20 could be extruded from the gripping device 30 via such a method as overmolding, or an actual drive shaft could be molded from the same material of which the gripping device 30 is formed. The first end 21 of the drive shaft 20 is shaped to fit into the receptacle end, or chuck, of a commercial hand held motorized rotary device 40. The first end 21 of the drive shaft 20 may be shaped in a hexagon (as is shown in FIG. 2) octagon, true cylindrical (as is shown in FIG. 6) or any shaft shape that is capable of fitting into a commercial hand held motorized rotary device 40. The drive shaft 20 may be made from metal, plastic composite and/or any material that is of a sufficient strength.

Figure 4:
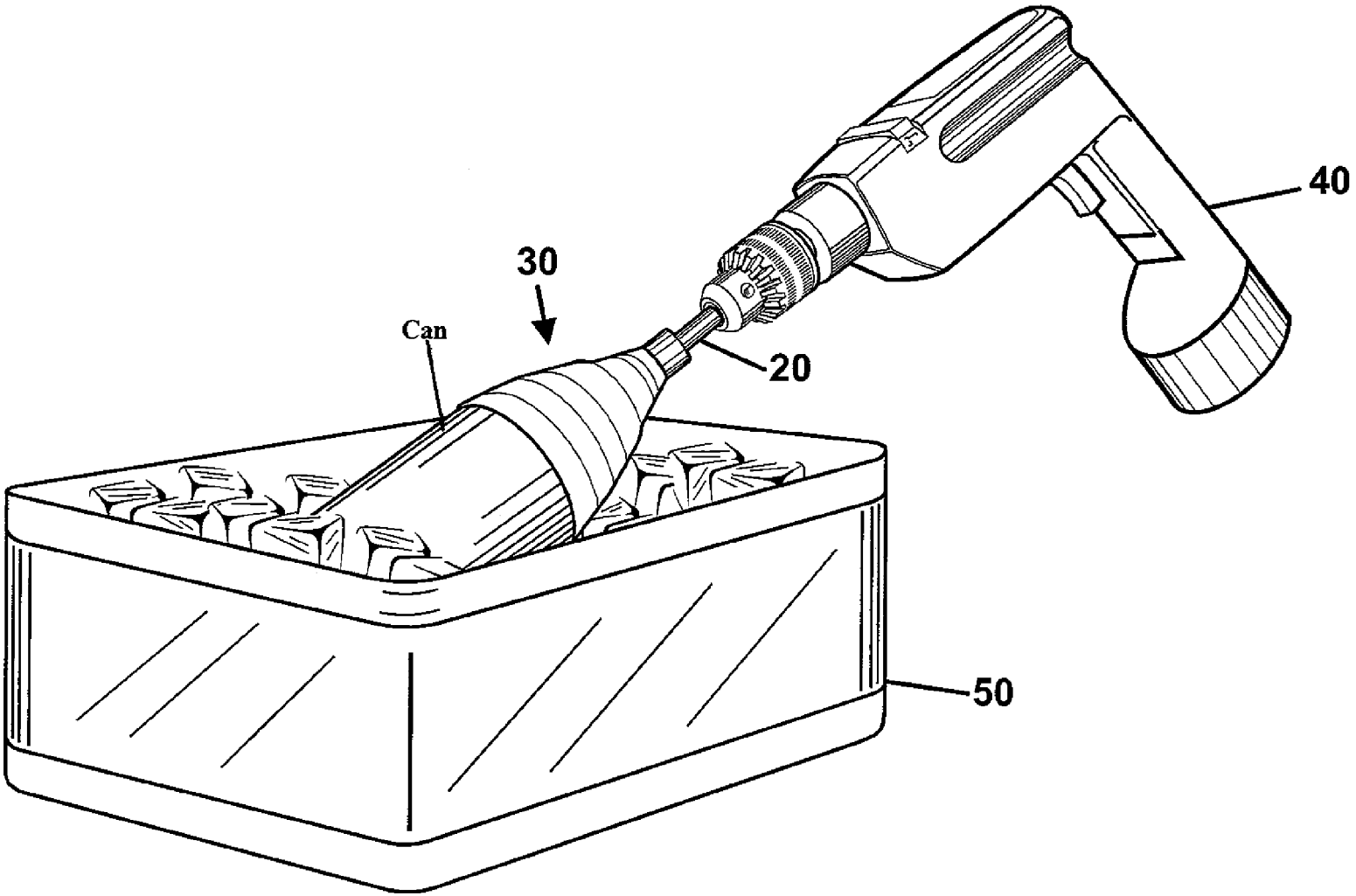
FIG. 4 is a perspective view of the present invention retaining a container of liquid which is placed in a chest of ice for cooling.

To use the present invention, the chuck of the motorized rotary device 40 is then tightened around the protruding drive shaft 20. The container is then inserted into the second end 34 of the gripping device 30 and the inner surface 32 frictionally grips the can or bottle. FIG. 4 shows how the can or bottle can then be inserted into a holding chest 50 filled with ice or icy water solution. The container can also be inserted into the gripping device 30 while the gripping device 30 is placed on the ice. The ice is typically the consistency of ice cubes, sheared ice, cracked ice or any combination and may be combined with water. Upon actuation of the motorized rotary device 40, the drive shaft 20 of the present invention 10 rotates, and the container also rotates while it is submerged in the ice or icy solution or laying on top of a bed of ice. The rotation causes any internal fluid contained within the container to swirl in the direction of the rotating drive shaft 20, causing a constant rotation of the internal fluid. The fluid circulation allows the warmer temperature of the fluids to transfer to the colder ice and cold water through the outer surface of the container. Once the desired temperature of the fluid in the container is achieved, the container may be removed by a slight reverse rotation and withdrawal from the second end 34 of the gripping device 30.

Additionally, the hand held motorized rotary device 40 used with this invention could be fitted with an on switch which can be retained in an on position without the user holding it, for an amount of time to be determined by the user.

Figure 9:
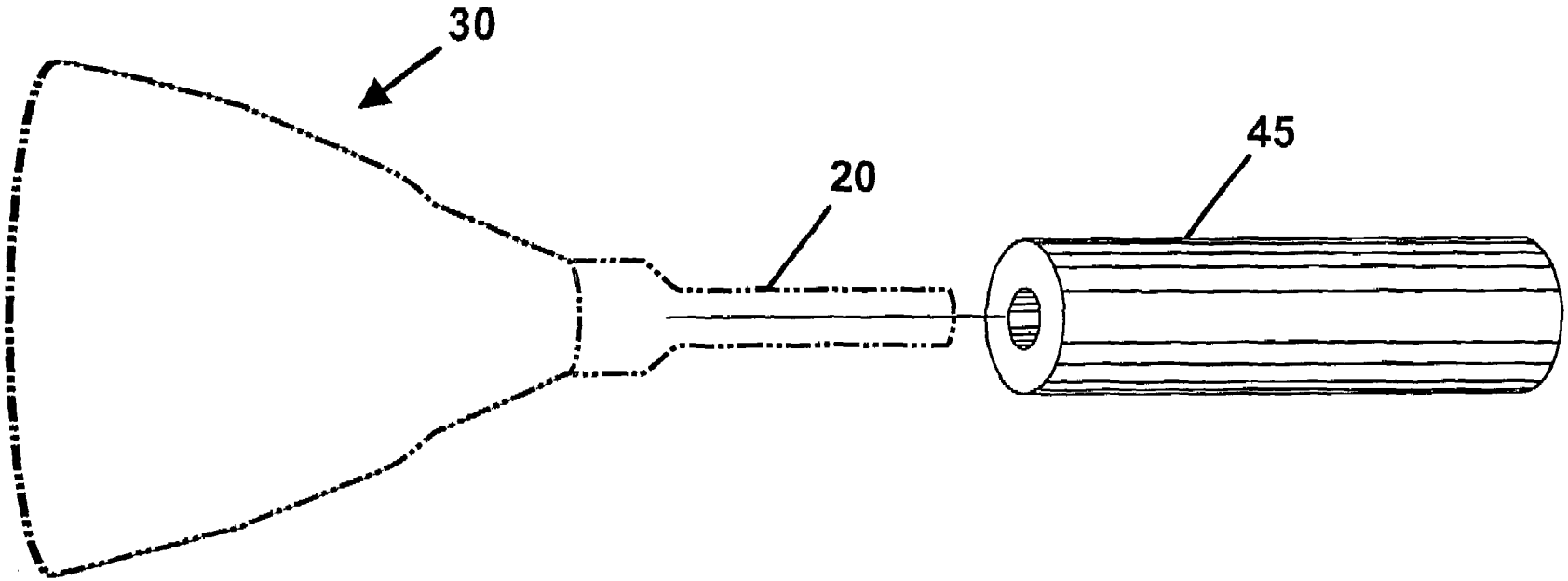
FIG. 9 is a perspective view of the present invention illustrating a detachable handle.

The present invention may also utilize a handle 45, which may be adapted to securely attach to the first end 21 of the drive shaft 20, as is shown in FIG. 9. The handle 45 may be detached when the user wishes to use the hand held motorized rotary device 40 or placed on the first end 21 of the drive shaft 20 if the hand held motorized rotary device 40 is not available. Using the handle 45 prevents the user from having to immerse his or her hand into the ice or icy solution.

The invention claimed is:

1. A container holding device comprising:

a drive shaft having a first end and a second end, said first end shaped so that it fits into a chuck of a hand held motorized rotary device;

a gripping device, having an inner surface and an outer surface, with a first end and a second end;

said first end of said gripping device having a diameter which is smaller than said second end of said gripping device;

said second end of said shaft connected to said first end of said gripping device; and said inner surface of said gripping device formed to frictionally grip a container.

2. A container holding device comprising:

a drive shaft having a first end and a second end;

a handle connected to said first end of said drive shaft;

a gripping device, having an inner surface and an outer surface, with a first end and a second end;

said second end of said shaft connected to said first end of said gripping device; and said inner surface of said gripping device formed with a protruding continuous spiral design.

3. The container holding device of claim 2 wherein said handle is detachable from said first end of said drive shaft.

4. The container holding device of claim 1 wherein said inner surface of said gripping device is textured.

5. The container holding device of claim 1 wherein said inner surface of said gripping device is a continuous spiral.

6. The container holding device of claim 1 wherein said gripping device further comprises at least two elongated rectangular notches in the said inner and outer surfaces traversing from the said first end to a distance before the said second end of the said gripping device.

7. A method for cooling a liquid in a container comprising:

insetting said container of liquid into the open end of a gripping device, said gripping device having a closed end and an open end and an inner and outer surface, said inner surface formed to frictionally grip said container of liquid;

attaching a drive shaft, which is securely attached to said first end of said gripping device, to a hand held motorized rotary device; and placing said container of liquid into a container filled with ice and rotating the container of liquid via actuation of the hand held motorized rotary device.

* * * * *